US006260633B1

(12) United States Patent
Machek et al.

(10) Patent No.: US 6,260,633 B1
(45) Date of Patent: Jul. 17, 2001

(54) SOIL SAMPLING APPARATUS REMOVABLY ATTACHABLE TO A VEHICLE

(76) Inventors: Michael D. Machek, 4017 Poplar Grove Rd., Midlothian, VA (US) 23112; John T. Fullen, P.O. Box 172, Union, WV (US) 24983

( * ) Notice: Subject to any disclaimer, the term of this patent is extended or adjusted under 35 U.S.C. 154(b) by 0 days.

(21) Appl. No.: 09/519,751

(22) Filed: Mar. 6, 2000

(51) Int. Cl.[7] ..... E21B 49/02

(52) U.S. Cl. ..... 175/20; 73/864.43; 73/864.45; 173/184

(58) Field of Search ..... 175/20, 58; 73/864.43, 73/864.44, 864.45; 173/184

(56) References Cited

U.S. PATENT DOCUMENTS

| | | | | |
|---|---|---|---|---|
| 2,468,319 | * | 4/1949 | Adams | 173/38 |
| 2,565,224 | * | 8/1951 | Gibbens | 173/40 |
| 3,224,512 | * | 12/1965 | Alexander | 173/19 |
| 3,464,504 | | 9/1969 | Stange . | |
| 3,593,809 | | 7/1971 | Derry . | |
| 4,316,393 | * | 2/1982 | Philipenko | 73/864.45 |
| 4,482,021 | * | 11/1984 | Repski | 175/209 |
| 5,076,372 | * | 12/1991 | Hellbusch | 175/20 |
| 5,394,949 | * | 3/1995 | Wright et al. | 175/20 |
| 5,542,476 | * | 8/1996 | Hansen | 172/22 |
| 5,950,741 | * | 9/1999 | Wright et al. | 175/20 |
| 6,016,713 | * | 1/2000 | Hale | 73/864.45 |

* cited by examiner

*Primary Examiner*—Hoang Dang
(74) *Attorney, Agent, or Firm*—Norman B. Rainer

(57) ABSTRACT

A soil sampling apparatus removably mountable upon a wheeled vehicle includes a mounting frame having elongated longitudinal members adapted to adjustably extend in the direction of the length of the vehicle, and paired parallel attachment members emergent from the longitudinal members and adapted to be secured to the vehicle. A center frame is vertically positionable by virtue of sliding engagement with bushings held by the longitudinal members. A bottom panel held by the center frame has an aperture and a guide tube upwardly directed from the panel in communication with the aperture. A motor slideably positioned within the center frame holds a downwardly directed auger adapted to enter the guide tube. The motor undergoes reciprocal vertical movement within the center frame by virtue of manual downward pushing and upward lifting accomplished within an operating lever. In the downward position of the motor, the auger is activated which causes a soil sample to be lifted through the guide tube and into a waiting container seated on the bottom panel.

8 Claims, 3 Drawing Sheets

SOIL SAMPLING APPARATUS REMOVABLY ATTACHABLE TO A VEHICLE

BACKGROUND OF THE INVENTION

1. Field of the Invention

The present invention concerns apparatus for collecting soil samples, and more particularly relates to such apparatus of a manually operable nature mountable upon a vehicle for enabling a single operator to collect samples for subsequent analysis.

2. Description of the Prior Art

In agricultural operations, it is often necessary for the farmer to ascertain the precise quality of his soil with respect to the soil's need for additives such as fertilizer, lime, herbicides and insecticides. This requires extensive soil testing, involving the collection of many soil samples for separate laboratory analysis. In related operations, it may be necessary to test soils for the presence of pollutants, and thereby determine suitable remediation measures.

Various types of mechanical soil samplers have been proposed, a number of them incorporating hollow tube probes in mechanisms supplying weight and power for causing the probe to penetrate hard soils. Examples of such devices are disclosed in U.S. Pat. Nos. 3,464,504, 4,284,150, 4,333,541, 4,685,339, and 4,828,047. Other mechanical samplers employ a rotatably driven auger shaft which bores into the soil and withdraws a sample upwardly into a receptacle. Such devices are disclosed, for example in U.S. Pat. Nos. 3,593,809, 4,482,021, 4,534,231, 5,076,372 and 5,394,949.

The aforesaid mechanical samplers are generally associated with a vehicle suitable for use on farmland. In some instances, the vehicle is dedicated to the one particular purpose of soil sampling. In other instances, the sampling apparatus, though potentially removable from the vehicle, is removable only with considerable difficulty. When associated with a vehicle, the sampling apparatus is usually operated by the vehicle's power sources.

In the preferred, auger-based soil sampling devices, two primary repetitive motions are involved, namely a reciprocating up and down movement of the auger, and an axial rotary motion of the auger during its penetration of the soil. If the vehicle's mechanical or electrical power capabilities are employed to produce the up and down motion, coupling and control components of considerable complexity and expense are required.

It is accordingly an object of the present invention to provide a soil sampling apparatus which may be removably mounted upon a vehicle suited for farm use.

It is another object of this invention to provide a soil sampling apparatus as in the foregoing object which employs an auger for upwardly advancing a soil sample into a container.

It is a further object of the present invention to provide a soil sampling apparatus of the aforesaid nature wherein up and down movement of said auger is manually affected by the vehicle operator, and axial rotary motion of the auger is produced by the vehicle's electrical system.

It is a still further object of the present invention to provide a soil sampling apparatus of the aforesaid nature of durable, simple construction amenable to low cost manufacture.

It is yet another object of this invention to provide soil sampling apparatus of the aforesaid nature which can be marketed in kit form for easy installation by the purchaser onto an existing vehicle.

These objects and other objects and advantages of the invention will be apparent from the following description.

SUMMARY OF THE INVENTION

The above and other beneficial objects and advantages are accomplished in accordance with the present invention by a soil sampling apparatus removably mountable upon one side of a wheeled vehicle having front and rear extremities, said apparatus comprising:

a) a mounting frame comprised of forward and rearward longitudinal elongated members adapted to adjustably extend between said front and rear extremities, and paired parallel attachment members emergent from said longitudinal members, said forward and rearward longitudinal members having facing extremities which separately secure vertically oriented first and second bushing means, respectively, b) a center frame comprised of front and rear upright tubular members elongated between upper and lower extremities and slidably secured by said first and second bushing means, respectively, and brace means connecting said upright members above said bushing means, c) a drilling assembly comprised of a horizontally disposed bottom panel having a centered aperture and an upwardly directed guide tube in communication with said aperture, outer track rods slideably positionable within said upright tubular members, and upwardly extending interior track means, d) an electric motor slideably retained by said interior track means and equipped with an auger drill extending downwardly into said guide tube, e) an operating lever having a downwardly directed proximal extremity pivotally held by said forward longitudinal member, and an upwardly directed distal extremity, said operating lever being removably cradled by said front upright member, f) a push rod interactive between said motor and operating lever and serving to force said motor downwardly, causing said auger to descend below said bottom panel, g) electrical switch means for activating said motor as said auger begins its descent below said bottom panel, and h) collector means removably positionable upon said bottom panel adjacent said guide tube for collecting a soil sample upwardly lifted by rotative movement of said auger.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
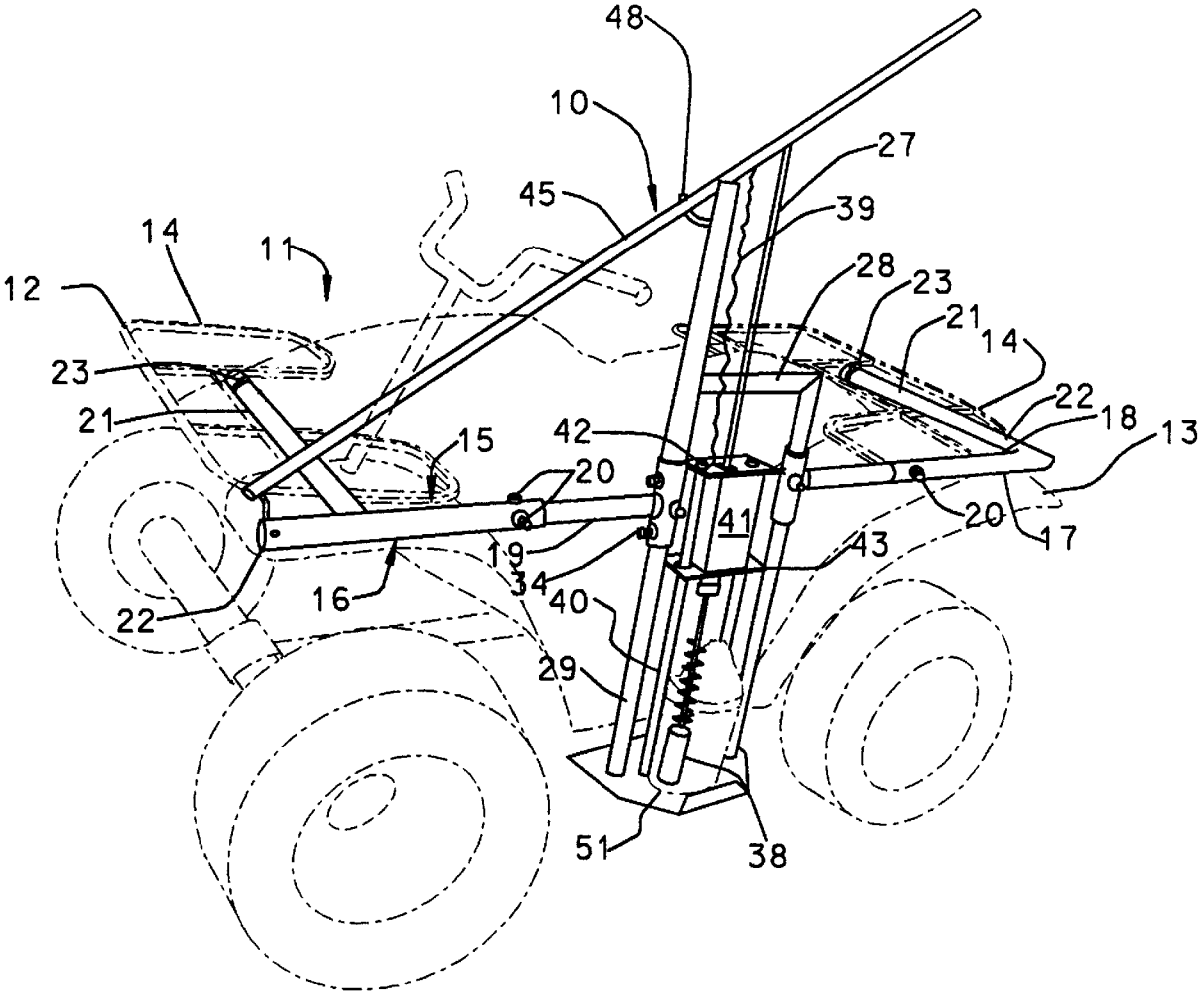
FIG. 1 is a side perspective view of an embodiment of the soil sampling apparatus of the present invention shown in association with a wheeled vehicle.
Figure 2:
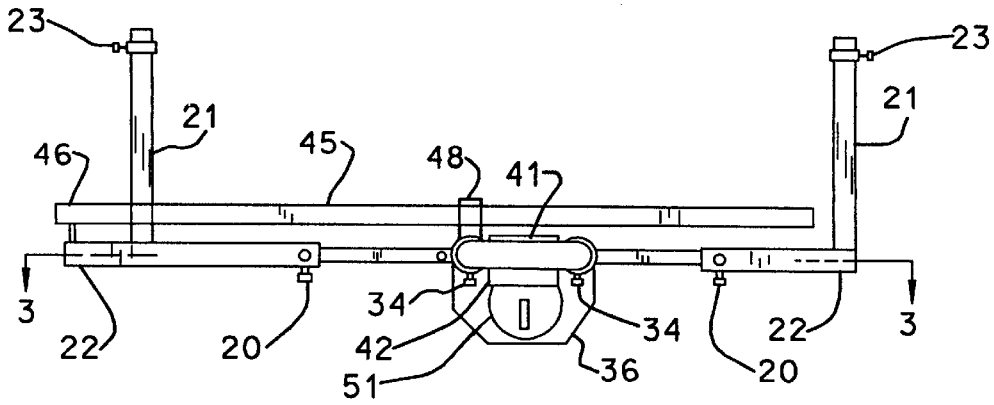
FIG. 2 is a top plan view of the apparatus of FIG. 1.
Figure 3:
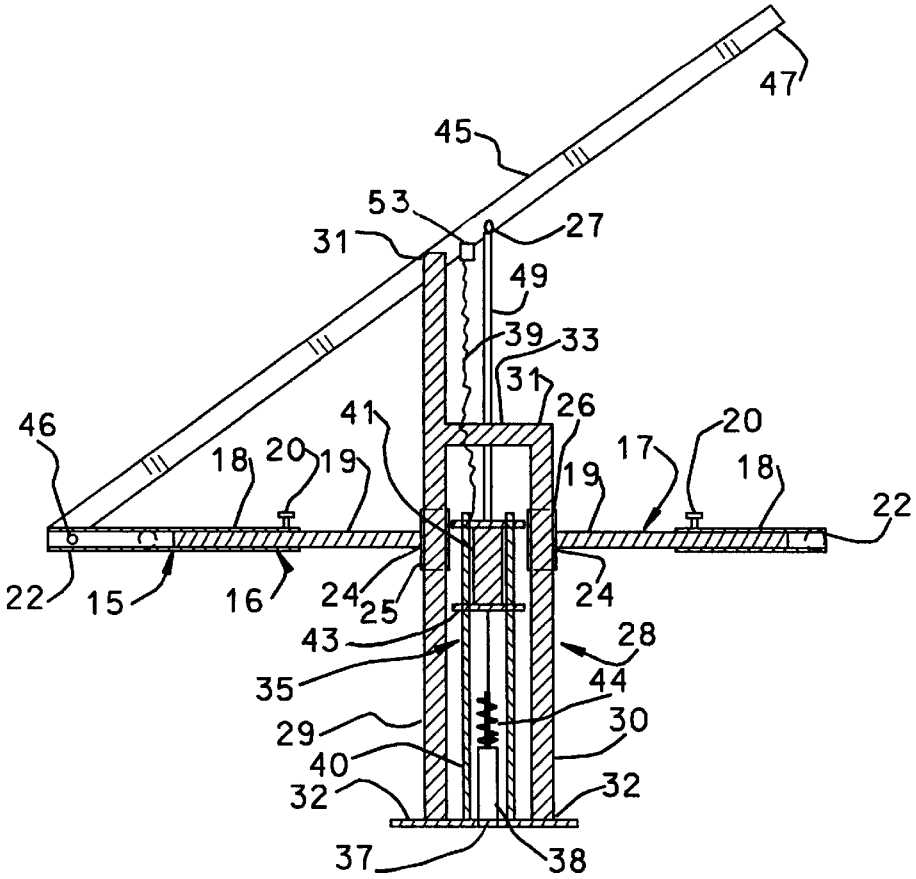
FIG. 3 is a sectional view taken in the direction of the arrows upon the line 3—3 of FIG. 2.
Figure 4:
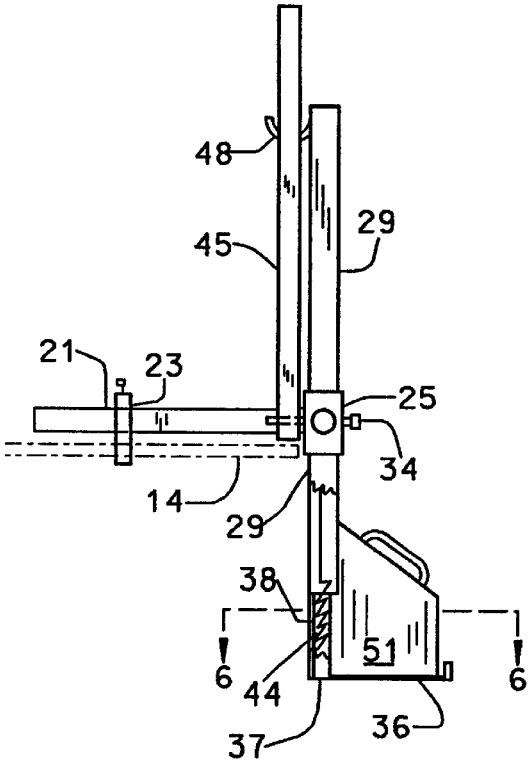
FIG. 4 is a front end view with portions cut away to reveal interior details.
Figure 5:
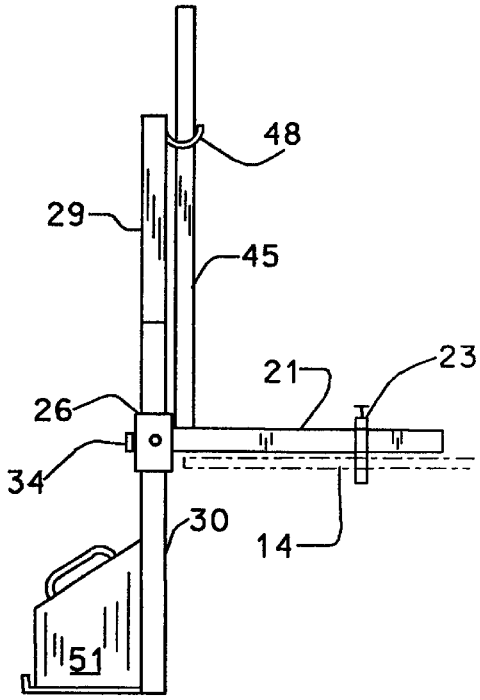
FIG. 5 is a rear end view.
Figure 6:
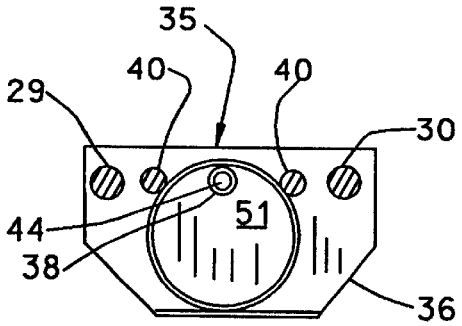
FIG. 6 is an enlarged sectional view taken in the direction of the arrows upon the line 6—6 of FIG. 4.

Referring now to FIGS. 1–6, an embodiment of the soil sampling apparatus 10 of the present invention is shown in operative association with a farm-type tractor vehicle 11 having front and rear extremities 12 and 13, respectively, equipped with utility racks 14.

Sampling apparatus 10 is comprised of mounting frame 15 and center frame 28. Said mounting frame is comprised of forward and rearward longitudinal elongated members 16 and 17, respectively, adapted to adjustably extend between the front and rear extremities of said vehicle. In the exemplified embodiment, adjustability is achieved by way of a telescoping feature wherein each of members 16 and 17 is of segmented construction consisting of an outer tube or pipe unit 18 and a slideably insertive inner unit 19. Locking bolts 20 threadably penetrate said outer units in a manner to tightly abut and thereby secure the associated inner unit. Both longitudinal members are preferably disposed in alignment upon a common horizontal axis.

Paired parallel attachment members, exemplified as pipes 21 are co-directionally emergent from said longitudinal members in substantially orthogonal relationship therewith. In the exemplified embodiment, pipes 21 are straight members welded to the outer extremities 22 of said longitudinal members. The function of said attachment members is to facilitate securement of the apparatus to utility racks 14. Such securement may be adjustably and releasibly achieved by means of pipe clamps 23 caused to embrace both an attachment pipe 21 and a structural feature of rack 14.

Said forward and rearward longitudinal members have facing interior extremities 24 which secure vertically oriented bushing means in the form of first and second sleeve bushings 25 and 26, respectively.

Center frame 28 is comprised of front and rear straight upright parallel members in the form of posts 29 and 30, respectively, each elongated between upper and lower extremities 31 and 32, respectively, and slideably interactive with said first and second sleeve bushings, respectively. A horizontal brace 33 fixedly joins said posts above said bushings. The exact elevation of said center frame with respect to mounting frame 15 is secured by locking bolts 34 which threadably penetrate said sleeve bushings. In some embodiments, said front and rear posts 29 and 30 may be of adjustable length by virtue of a telescoping construction employing an outer pipe.

A drilling assembly 35 is located within center frame 28, said assembly being comprised of a horizontally disposed bottom panel 36 having a centered aperture 37 and an upwardly directed guide tube 38 communicating with said aperture. Track means in the form of paired straight parallel rods 40 extend upwardly from panel 36.

An electric motor 41 is equipped with guide means in the form of apertured top and bottom plates 42 and 43, respectively, which slideably engage said track rods 40, thereby permitting reciprocating vertical movement of said motor within said center frame. An auger drill 44 activated by said motor extends downwardly into said guide tube.

An operating lever 45 having a downwardly directed proximal extremity 46 is pivotally joined at said proximal extremity to forward longitudinal member 16, preferably at the forward most extremity of said member 16. Said lever 45 extends obliquely upwardly from proximal extremity 46, terminating in upwardly directed distal extremity 47. Lever 45 is removably supported by cradle 48 attached to the uppermost extremity of front upright post 29. Said cradle not only positions lever 45 at a convenient disposition for use by the operator, but prevents gravity-induced descent of said lever.

A push rod 49 is interactive between motor 41 and a site 27 on lever 45 preferably located rearward of front upright post 29. The function of said push rod is to enable downward movement of lever 45 to force motor 41 downwardly, causing auger 44 to descend below bottom panel 36. The manner of engagement of said push rod with motor 41 is such that upward movement of lever 45 raises said motor to an upper, starting position, said starting position being dictated in part by the location of cradle 48 and the length of the push rod.

Electrical switch means 53 and power cord 39 are interactive with lever 45 and said motor. The function of said switch means is to achieve automatic or manually controlled energization of said motor as said auger begins its descent below said bottom panel, and deactivation of the motor when the auger is lifted to its starting position above the bottom panel.

Collector means in the form of a specially contoured plastic container 51 is removably positionable upon said bottom panel adjacent said guide tube for collecting a soil sample upwardly lifted by rotative movement of said auger.

In use, the apparatus of this invention is installed onto a vehicle by first adjusting the lengths of the longitudinal members by telescoping action and securement by way of locking bolts 20. Attachment members 21 are clamped to the front and rear utility racks of the vehicle. The elevation of center frame 28 is adjusted by sliding motion with respect to said sleeve bushings, and secured in place by locking bolts 34, causing panel 36 to rest upon the soil surface. To produce a soil sample, lever 45 is removed from retaining cradle 48, then forced downwardly and restored upwardly, such action producing a soil sample which is automatically deposited into container 51. Each soil sample can be dumped into specimen jars which are labelled and held for laboratory analysis. Alternatively, a multitude of samples may be collected before container 51 is dumped, thereby producing a specimen representing the averaged characteristics of the land area being tested. A further advantage of the apparatus of this invention is that the several components can be disassembled and easily packaged for shipment and distribution.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described our invention, what is claimed is:

1. A soil sampling apparatus removably mountable upon a wheeled vehicle having front and rear extremities, said apparatus comprising:

a) a mounting frame comprised of forward and rearward longitudinal elongated members adapted to adjustably extend toward said front and rear extremities, and paired parallel attachment members emergent from said longitudinal members, said forward and rearward longitudinal members having facing extremities which separately secure vertically oriented first and second bushing means, respectively, b) a center frame comprised of front and rear parallel upright members elongated between upper and lower extremities and slidably secured by said first and second bushing means, respectively, and brace means connecting said upright members above said bushing means, c) a drilling assembly secured to the lower extremities of said upright members and comprised of a horizontally disposed bottom panel having an aperture and an upwardly directed guide tube in communication with said aperture, and upwardly extending track means, d) an electric motor slideably retained by said track means and equipped with an auger drill extending downwardly into said guide tube, e) an operating lever having a downwardly directed proximal extremity pivotally held by said forward longitudinal member, and an upwardly directed distal extremity, said operating lever being removably cradled by said front upright member, f) a push rod interactive between said motor and operating lever and serving to force said motor downwardly, causing said auger to descend below said bottom panel, g) electrical switch means for activating said motor as said auger begins its descent below said bottom panel, and h) collector means removably positionable upon said bottom panel adjacent said guide tube for collecting a soil sample upwardly lifted by rotative movement of said auger.

2. The apparatus of claim 1 in the form of a kit which enables the purchaser of the kit to install said apparatus upon an existing vehicle.

3. The kit of claim 2 further including at least two clamps to facilitate securement of said attachment member to said vehicle.

4. The apparatus of claim 1 wherein said forward and rearward longitudinal elongated members extend to outer extremities which are oppositely directed from said facing extremities.

5. The apparatus of claim 4 wherein said paired parallel attachment members are emergent from said longitudinal members at sites adjacent said outer extremities of said longitudinal members.

6. The apparatus of claim 1 wherein said motor is equipped with guide means which slideably engage said track means.

7. The apparatus of claim 6 wherein said track means are a pair of parallel straight rods slidingly interactive with said guide means and permitting reciprocating vertical movement of said motor within said center frame.

8. The apparatus of claim 1 wherein said push rod interacts with said operating lever at a site located rearward of said front upright member.

* * * * *